United States Patent [19]

Anderson

[11] Patent Number: 5,003,648

[45] Date of Patent: Apr. 2, 1991

[54] LIGHT FOR TOILET BOWL

[76] Inventor: Alexander A. Anderson, 605 Antietam Dr., Stone Mountain, Ga. 30087

[21] Appl. No.: 443,168

[22] Filed: Nov. 30, 1989

[51] Int. Cl.[5] ..... A47K 17/02; E03D 1/00

[52] U.S. Cl. ..... 4/661; 4/314

[58] Field of Search ..... 4/661, 314; 362/96, 362/101

[56] References Cited

U.S. PATENT DOCUMENTS

| | | | |
|---|---|---|---|
| 3,982,288 | 9/1976 | Borne | 4/237 |
| 4,413,364 | 11/1983 | Bittaker et al. | 4/661 |
| 4,491,991 | 1/1985 | Herbruck | 4/239 |
| 4,547,768 | 10/1985 | Kulhary | 4/661 |
| 4,623,955 | 11/1986 | Santini | 4/661 |
| 4,636,474 | 1/1987 | Ogura et al. | 4/661 |
| 4,733,419 | 3/1988 | Nee | 4/661 |
| 4,736,471 | 4/1988 | Johnson | 4/661 |
| 4,849,742 | 7/1989 | Warrington | 4/661 |
| 4,860,178 | 8/1989 | Picon | 4/661 |
| 4,883,749 | 11/1989 | Roberts et al. | 4/304 |

*Primary Examiner*—Henry J. Recla
*Assistant Examiner*—Keith Kupferschmid
*Attorney, Agent, or Firm*—James B. Middleton

[57] ABSTRACT

A light for lighting the bowl of a toilet includes a horseshoe shaped web to lie on top of the rim of the toilet. Flanges extend from the web outside of the bowl to hold the web in position. Flanges extend inside the bowl and carry lights. The flanges shield the lights for protection of the lights, and to provide indirect lighting for the bowl. A housing at the rear of the toilet carries a switch for engagement by the lid of the toilet, so the light is turned on when the lid is up. The housing also receives batteries for powering the lights.

5 Claims, 1 Drawing Sheet

LIGHT FOR TOILET BOWL

Someone very often needs to use the toilet after all the lights in the house have been turned out. While it is easy enough to turn on lights, the lights may disturb others; and, when a person's eyes are dark-adapted, the sudden brightness of full lighting is very uncomfortable.

There have been numerous efforts to deal with the problem of lighting one's way to a toilet. One solution is to utilize a constantly illuminated night light in the bathroom. While this will assist a person in finding the bathroom, the toilet itself may be so poorly lighted that it cannot easily be located. Another solution to the problem is the provision of a light in or on the toilet itself.

Prior art lights for a toilet include U.S. Pat. No. 4,736,471 which discloses a light carried by the lid of the toilet. Such an arrangement requires that all the apparatus be contained in one package and adhered to the lid. This is unhandy, and could easily be inadvertently displaced. U.S. Pat. No. 3,982,288 discloses a seat that is lighted. The seat itself must be at least somewhat light transmitting, and the light is provided by a light conducting element within the seat. The entire seat must therefore be specifically constructed for this light. Further, a light source must be mounted in or on the toilet bowl to provide light to the light conducting element. Thus, the arrangement is quite complex, and requires complete replacement of several otherwise conventional parts. U.S. Pat. No. 4,413,364 discloses a light carrying member adhesively fixed at the rear of the toilet bowl, with a light extending into the bowl, the light being hooded to direct light into the bowl. The device includes only one light source, and that one source is at the rear of the toilet bowl, arranged to direct light downwardly into the bowl. The lighting of the bowl will therefore be rather poor.

SUMMARY OF THE INVENTION

This invention relates generally to lighting means, and is more particularly concerned with a night light for a toilet.

The present invention provides a lighting means for a toilet bowl, the lighting means including a web supported on the upper surface of the toilet bowl. There are flanges depending from the web, at least one flange extending outside the toilet bowl to align the web with respect to the bowl, and at least one other flange extending inside the toilet bowl, and carrying a light. The light is preferably within a sealed enclosure to prevent damage by splashed water.

In one embodiment of the invention the apparatus includes a housing fixed to the web and located at the rear of the bowl. The housing may include a switch engageable by the lid portion of the toilet seat and may include batteries as a power source.

BRIEF DESCRIPTION OF THE DRAWINGS

These and other features and advantages of the present invention will become apparent from consideration of the following specification when taken in conjunction with the accompanying drawing in which.

DETAILED DESCRIPTION OF THE EMBODIMENT

Figure 1:
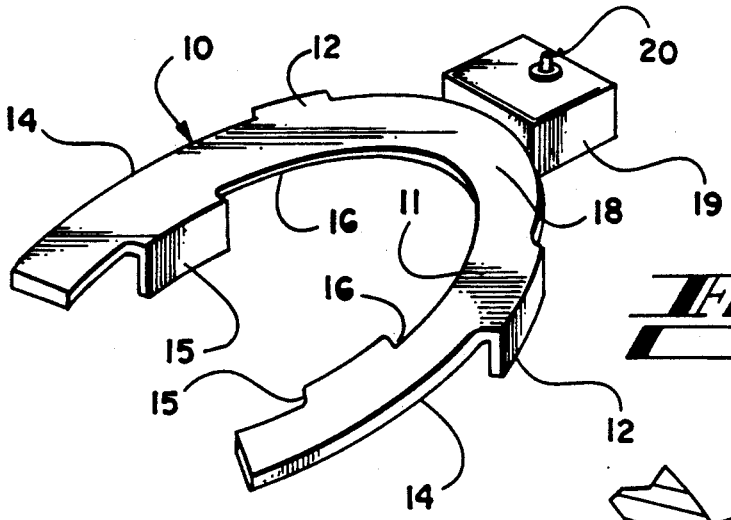
FIG. 1 is a perspective view of a light for a toilet bowl, made in accordance with the present invention.

Referring now more particularly to the drawings, and to that embodiment of the invention here presented by way of illustration, it will be seen in FIG. 1 that the lighting means generally designated at 10 includes a horseshoe shaped web 11 which will have a size and shape to fit on the upper rim of a toilet bowl. Those skilled in the art will realize that there are a few different shapes of bowls, but many of the shapes are similar enough that one lighting means 10 should fit a rather wide variety of toilet bowls.

The horseshoe shaped web 11 is here shown as having integrally formed depending flanges 12 at the outside edge 14 of the web 11. Since the web 11 is to be received on the upper rim of the bowl, it will be understood that the flanges 12 extend outside the bowl, and will therefore assist in preventing displacement of the web 11 with respect to the toilet bowl. There are two of the flanges 12, one on each side of the toilet bowl. Movement of the web 11 in either direction is therefore restrained.

Forwardly of the depending flanges 12, there are two depending flanges 15 that are carried by the inner edge 16 of the web 11, and consequently extend on the inside of the toilet bowl. As will be seen in more detail hereinafter, the flanges 15 carry the lights for lighting the toilet bowl.

At this point it will be seen that the present invention provides a lighting means receivable on the upper rim of a toilet bowl, the lighting means including a web extending a considerable distance around the rim to carry lights somewhat forward in the toilet bowl. The lights are therefore placed to illuminate the entire toilet bowl, but with a very low level of lighting. Since the lights themselves are covered by the web 11 and the flanges 15, the lights are reasonably well protected from mechanical or liquid damage.

At the rearmost edge of the web 11, or at the apex 18, there is a housing generally designated at 19. The housing 19 is here shown as a rectangular box having a switch 20 extending therefrom. In one embodiment of the invention, it is contemplated that the housing 19 will include batteries as the electric power source, the switch 20 being connected in series with the batteries to turn the lights on and off. This arrangement will be discussed in more detail below.

Figure 2:
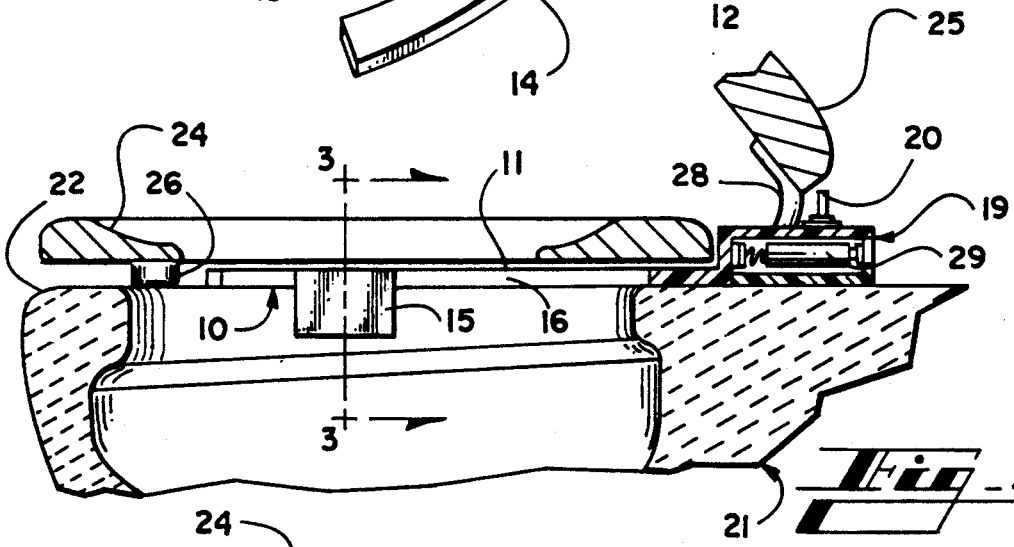
FIG. 2 is a longitudinal cross-sectional view taken through a toilet bowl having the device of FIG. 1 installed thereon; and, FIG. 3 is an enlarged cross-sectional view taken substantially along the line 3—3 in FIG. 2.

Looking at FIG. 2 of the drawings, the toilet bowl is shown fragmentarily at 21, the bowl having an upper rim 22 which receives the web 11 of the lighting means 10. In FIG. 2 it will be observed that the toilet bowl 21 includes a seat having a ring 24 and a lid 25. The ring 24 is shown in its use position, with bumpers 26 resting on the rim 22 of the toilet bowl. With the lighting means 10 in position, it will be seen that the lid 25 is carried by a hinge member 28, and the switch 20 is so placed as to be engaged by the lid 25 when the lid 25 is raised. When the switch 20 is depressed, the batteries 29 will be connected to the light to illuminate the toilet bowl 21.

In the preferred form of the invention, the web 11 is thin enough that it will fit beneath the ring 24 while allowing the ring 24 to assume its normal position. Since the web 11 is primarily to support the lights, there will be no problems encountered in providing such a web.

Figure 3:
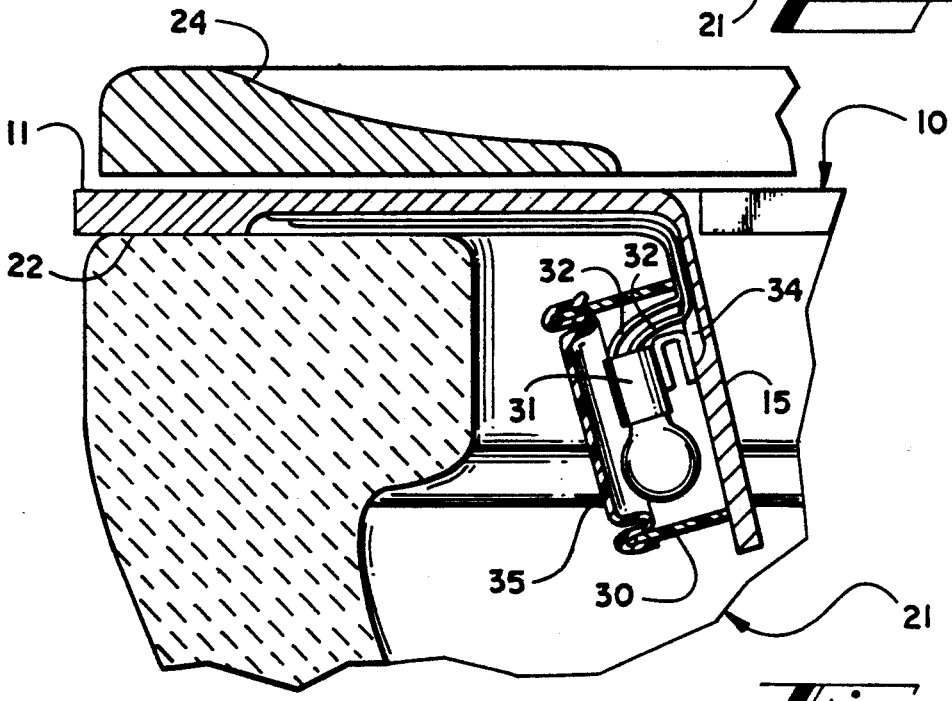

Attention is next directed to FIG. 3 of the drawings which shows the light in more detail. In FIG. 3, it will be seen that the flange 15 is spaced from the rim 22 of the toilet bowl 21 sufficiently to provide a space to receive a light. The light here presented by way of illustration includes a container 30 carried by the flange 15, on the side of the flange towards the toilet rim 22. The container 30 includes a light socket 31 and electrical wires 32 extending from the socket 31. It will be seen that the wires 32 are received within a groove 34 in the flange 15, and in the web 11. It is contemplated that the lighting means 10 will be molded or otherwise formed with the groove 34 for receiving the wires 32 so the light socket and wires can be added later. If desired, glue, caulk or the like can be used to fill the groove and hold the wires in place.

To render the light 31 further waterproof, there is a removable cover 35 receivable over the edges of the container 30. The cover 35 is preferably transparent or translucent to provide the desired amount of lighting with the cover in place.

While the light here shown includes a conventional incandescent light bulb and a socket therefor, it will be understood by those skilled in the art that other forms of light might be used as well. By way of example, an electroluminescent panel could be used, and would of course allow the flange 15 to be quite close to the toilet bowl rim 22. The flange 15 can be appropriately sized for the panel needed to yield the preferred light output.

From the foregoing description, it will be understood by those skilled in the art that the present invention provides a light for a toilet bowl, the lighting means including a web receivable on the rim of the toilet bowl, and depending flanges for holding the web in place. Flanges extending into the toilet bowl carry lights, and the lights are sufficiently enclosed that there is no chance that the lights will be damaged by liquid contact, or by mechanical contact. Though the lighting means is quite secure when in place, the device can be easily removed from the toilet bowl for thorough and easy cleaning. It is contemplated that the device will be made of plastic or other easily cleaned material so it can remain sanitary through long use. While battery operation has been here disclosed, with a pushbutton switch, those skilled in the art will realize that other power sources may be used, and other types of switches may be used if desired.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A light means for use on a toilet rim having front, back and opposite sides, said light means including a web shaped to overlie with the toilet rim from one side, across the back to the opposite side and being receivable on the toilet rim, said web having an outside edge outwardly of the rim and an inside edge inwardly of the rim, at least one holding flange depending from said outside edge of said web, and at least one light flange depending from said inside edge of said web, a light carried by said at least one light flange, and electrical circuit means for connecting said light to a source of power, said at least one holding flange including two holding flanges, one holding flange being located on each side of said web for holding said web in place on a toilet rim, said at least one light flange including two light flanges, one light flange being on each side of said web for lighting both sides of a toilet, and further including a housing at the rear apex of said web, switch means carried by said housing, and a power source in said housing for connection to said circuit means.

2. The combination of a light means and a toilet, said toilet including a bowl having a rim, said bowl having a front and a back, and a seat including a ring and a lid, said seat being hinged to said bowl at said back of said bowl, said light means including a horseshoe shaped web that is shaped to coincide with the rim such that the entire web lies above the rim of said toilet and being receivable on said rim of said toilet, said web having an outside edge outwardly of said rim and an inside edge inwardly of said rim, a pair of holding flanges depending from said outside edge of said web and lying adjacent to said rim, and at least one light flange depending from said inside edge of said web and extending into said bowl, said light flange being placed forwardly within said toilet bowl, a light carried by said at least one light flange and extending towards said rim, and electrical circuit means for connecting said light to a source of power.

3. The combination of a light means and a toilet, said toilet including a bowl having a rim, aid bowl having a front and a back, and a seat including a ring and a lid, said seat being hinged to said bowl at said back of said bowl, said light means including a web that is shaped to coincide with the rim of said toilet and being receivable on said rim of said toilet, said web having an outside edge outwardly of said rim and an inside edge inwardly of said rim, at least one holding flange depending from said outside edge of said web and lying adjacent to said rim, and at least one light flange depending from said inside edge of said web and extending into said bowl, a light carried by said at least one light flange and extending towards said rim, and electrical circuit means for connecting said light to a source of power, said at least one holding flange including two holding flanges, one holding flange being located on each side of said web and extending down adjacent to opposite sides of said rim for holding said web in place on said rim of said toilet, said at least one light flange including two light flanges, one light flange being on each side of said web and extending into opposite sides of said toilet bowl for lighting both sides of said toilet, and further including a housing at the rear apex of said web, switch means carried by said housing, and a power source in said housing for connection to said circuit means.

4. The combination as claimed in claim 3, said switch means being located for engagement by said lid portion of said toilet seat.

5. The combination as claimed in claim 4, said housing including at least one battery for use as a power source for lighting said lights.

* * * * *